US010364616B2

(12) United States Patent
Hardy

(10) Patent No.: US 10,364,616 B2
(45) Date of Patent: Jul. 30, 2019

(54) ANCHOR SPOOL

(71) Applicant: Mark James Hardy, Arnaudville, LA (US)

(72) Inventor: Mark James Hardy, Arnaudville, LA (US)

( * ) Notice: Subject to any disclaimer, the term of this patent is extended or adjusted under 35 U.S.C. 154(b) by 14 days.

(21) Appl. No.: 15/836,068

(22) Filed: Dec. 8, 2017

(65) Prior Publication Data

US 2018/0100378 A1 Apr. 12, 2018

Related U.S. Application Data

(63) Continuation-in-part of application No. PCT/US2015/035581, filed on Jun. 12, 2015.

(51) Int. Cl.

| | |
|---|---|
| ***E21B 15/00*** | (2006.01) |
| *E21B 41/00* | (2006.01) |
| *E21B 19/00* | (2006.01) |
| *E21B 33/03* | (2006.01) |

(52) U.S. Cl.

CPC ..... *E21B 15/00* (2013.01); *E21B 19/00* (2013.01); *E21B 33/03* (2013.01); *E21B 41/00* (2013.01)

(58) Field of Classification Search

CPC ..... E21B 15/00

See application file for complete search history.

(56) References Cited

U.S. PATENT DOCUMENTS

| | | | | |
|---|---|---|---|---|
| 6,681,894 | B1 | 1/2004 | Fanguy | |
| 7,484,558 | B2 * | 2/2009 | Wood | E21B 15/006 166/75.14 |
| 2006/0266511 | A1 | 11/2006 | Wood | |
| 2012/0085552 | A1 * | 4/2012 | Travis | E21B 33/0415 166/382 |

OTHER PUBLICATIONS

PCT Application No. US2015/035581; International Search Report of the International Searching Authority for Applicant Mark James Hardy dated Sep. 21, 2015.

"Spacer Spools—Riser Spool," CCSC Petroleum Equipment Co., Ltd. retrieved from https://web.archive.org/web/20141021125024/http://www.ccscpetro.com/spacer-spool.html on Jan. 5, 2018.

* cited by examiner

*Primary Examiner* — Kristyn A Hall

(74) *Attorney, Agent, or Firm* — Jones Walker LLP

(57) ABSTRACT

A tubular anchor spool having a plurality of removably attached, radially extending, support beams removably attached to a BOP stack of a wellbore to provide a temporary support framework for workover equipment such as a snubbing unit. Guywires are attached to the support beams of the temporary framework for support of the workover equipment. The anchor spool is fabricated offsite and delivered to the well site for installation.

20 Claims, 8 Drawing Sheets

ANCHOR SPOOL

CROSS REFERENCE TO RELATED APPLICATION

This application is a continuation-in-part of PCT/US2015/035581 filed Jun. 12, 2015, which is incorporated by reference herein in its entirety.

FIELD OF THE INVENTION

This invention relates to offshore drilling and production of oil and gas. More specifically, the invention relates to a temporary support assembly for workbaskets or other platforms used for well workover operations at a well site such as snubbing operations, coiled tubing operations, and other wellbore applications.

BACKGROUND

A stack of wellbore blowout preventers (BOP stack) incorporated with the riser piping of a wellbore casing system maintains and controls pressure in the wellbore of an oil and gas well. Often it is necessary to perform well workover operations such as snubbing. Snubbing is the process of running or inserting pipe into the wellbore with specialized equipment called a snubbing unit when the blowout preventers of the BOP stack are controlling wellbore pressure. A snubbing unit is typically comprised of traveling and stationary slips, hydraulic jacks, a work window and a workbasket that extends above the BOP stack. The workbasket carries the workers used to perform the snubbing operations and also carries the pipe handling equipment, such as a tong arm, tongs, a gin pole, and their associated controls, and the controls necessary to operate the BOPs, the traveling and stationary slips, and the hydraulic jacks. A snubbing unit can also be used for a variety of well operations including fishing, milling, drilling, side tracking, and installing and removing bridge plugs when a drilling rig is not available.

In an onshore application, ground anchors with attached guywires and cables are used to support the workbasket, snubbing jack, and work window of a snubbing unit mounted on an associated BOP stack. At an offshore location, the workbasket, snubbing jack, and work window of a snubbing unit and the associated BOP stack are supported by guywires or cables that extend to a platform deck or to a temporary framework attached to the platform, or to the outer casing string, or conductor pipe. The temporary support framework must be prepared before installation of the snubbing unit. Engineering analysis must be performed to verify the structural integrity of the temporary framework.

Often the temporary support framework must be tailored and fabricated at the well site before the snubbing unit can be set up for operation. This tailoring and fabrication at the well site increases the time and expense associated with installation of a snubbing unit and may exposes workers to an increased risk of injury. Engineering analysis of the temporary support framework may have to be repeated. Often additional engineering analysis is not performed. After the job is completed, the temporary framework must be removed which adds additional cost to the project and to risk of worker injuries.

The conventional temporary support framework at an offshore well site is typically more economically installed ahead of the workover unit and crew using a small liftboat or other type of jackup vessel. When a larger jackup vessel was previously used at the same location, the ability to position a smaller jackup vessel is sometimes limited. The spud can holes of a jackup vessel leave a footprint on the water bottom. These footprints can cause significant structural problems when a smaller jackup vessel having different leg spacing is jacked up in the same area. To prevent the legs of the smaller jackup vessel from sliding or shifting into the spud can holes of a previous vessel, the smaller jackup vessel must be kept a safe distance away from the can hole footprint. Encroachment on the footprint of a larger jackup vessel can cause the smaller vessel to shift and lose its position on the water bottom. A shift in position can cause significant leg damage to the smaller jackup vessel and in extreme cases a leg may break and topple the vessel. This restriction on positioning may impede the installation of the temporary support platform if the liftboat or jackup vessel being used for installation of the temporary platform has limited crane capabilities. The vessel may have to be jacked down and moved over to the opposite side of the wellhead platform and repositioned for installation of the temporary support structure beams. Adverse weather also has an impact on the use of liftboat or jackup vessels, and such weather can delay the rigging of temporary offshore support platforms when the use of a liftboat or jackup vessel is required.

If welding is required for installation of a temporary support structure, adjacent producing wells will likely have to be shut in to guard against explosion and fire and to safeguard personnel and property. Once wells are shut, it is often difficult to bring a shut in well back on line and further well intervention such as nitrogen lifting, wireline swabbing, or the like may be required to place the well in service. The anticipated loss of production caused by having to shut in producing wells may be the driving factor in not repairing a non-producing well on the same platform and valuable oil and gas may be left in the ground at the end of field life.

When rigging up a temporary support structure in the conventional manner, engineers and planners try to prevent eccentric or side loads on the support structure beams. However obstructions at a well site such as platform hand rails, flow lines, ladders, and production facilities will often require the temporary support structure beams to be placed at awkward angles. When this occurs, the support structure beams may have to be upsized to handle the eccentric loading. In many cases these obstructions cannot be fully determined until the construction crews arrive at a platform. This can slow down installation of the temporary support structure or result in using support structure beams which do not meet proper engineering standards.

Many existing platforms have flow lines, ladders or handrails attached to the platform legs which can prevent or impede the installation of a temporary support platform. These obstacles often must be removed which adds further costs to the project. The removal of flow lines can also lead to leaks causing environmental problems.

Some platforms and wells are old and proper drawings and engineering calculations may not be readily available. In such situations, a structural team must be sent to the well site to create as built drawings and to assess the level of corrosion and deterioration of the existing wellhead and platform and its ability to support a temporary support structure.

Guywires rigged to fixed platforms are often used in constructing these temporary support platforms. When a snubbing unit or other equipment is mounted directly on the casing string, there is a risk that the casing string will shift or fall due to the weight of the snubbing unit and associated equipment and hook loads. This shifting may cause the guywires to become slack causing the unit to lean to one side or topple over causing damage to equipment, injury to workers, and possible loss of well control.

There is a need for a device that will aid in the construction of a temporary support structure for workbaskets and other platforms for well workover operations that will help to resolve the problems currently associated with such temporary structures. There is also a need for a support structure that may be attached directly to the casing string with minimal tailoring and fabrication at the well site and that can be readily removed when work is completed. There is also a need for a support structure that will reduce the time and expense associated with platform or workbasket installation and minimize the risk of damage to the wellhead and the risk of injury to workers

SUMMARY OF THE INVENTION

The present invention is an anchor spool that provides a temporary support structure to satisfy the aforementioned needs. The anchor spool may be incorporated into a wellbore pressure containment system of an oil and gas well which may be comprised of a column of piping segments called risers or riser spools that includes a stack of wellbore blowout preventers.

The anchor spool is comprised of a tubular body that has an axial central bore and a plurality of detachable, radially extending, cantilevered support beams. The body of the anchor spool is attached to the mounting flanges, including any intervening ring gaskets, of an existing riser spool and BOP stack of the existing wellbore casing string by means of threaded bolt holes and corresponding anchor bolts so that the central bore of the body is axially in line with the wellbore. The support beams are removably attached to the anchor spool body. The anchor spool may be provided with beam pockets or sleeves and pins for securing the support beams.

The anchor spool is readily incorporated with the existing riser spools or the BOP stack of the wellbore pressure containment system of the existing wellbore casing string and reduces the need for tailoring and fabrication of a support framework at a well site prior to installation of a snubbing unit or other such equipment when compared to conventional rigging methods. If necessary, additional riser piping may also be incorporated with the anchor spool.

The anchor spool will reduce the time associated with setting up a snubbing unit or other equipment at the well site and reduce the risk of injury to workers during installation and use of such equipment. The described anchor spool will also reduce eccentric loading on platform support beams because the support beams may be placed directly in line with the corners of a workbasket when the anchor spool is incorporated into the BOP stack. If casing slippage occurs, the anchor spool is integral to the casing string and will remain in place relative to the casing to maintain the tension on attached guy lines to prevent toppling of a workbasket or platform.

The anchor spool eliminates the need for a liftboat to travel to the location beforehand to prepare the platform and afterwards to retrieve the beams. This minimizes the risks associated with adverse weather which can reduce costs of the job.

The anchor spool also eliminates the need to perform guy wire calculations or additional engineering analysis each time the unit is rigged up which is suggested by the Minerals Management Service or Bureau of Safety and Environmental Enforcement (BSEE).

DESCRIPTION OF THE EMBODIMENT

Figure 1:
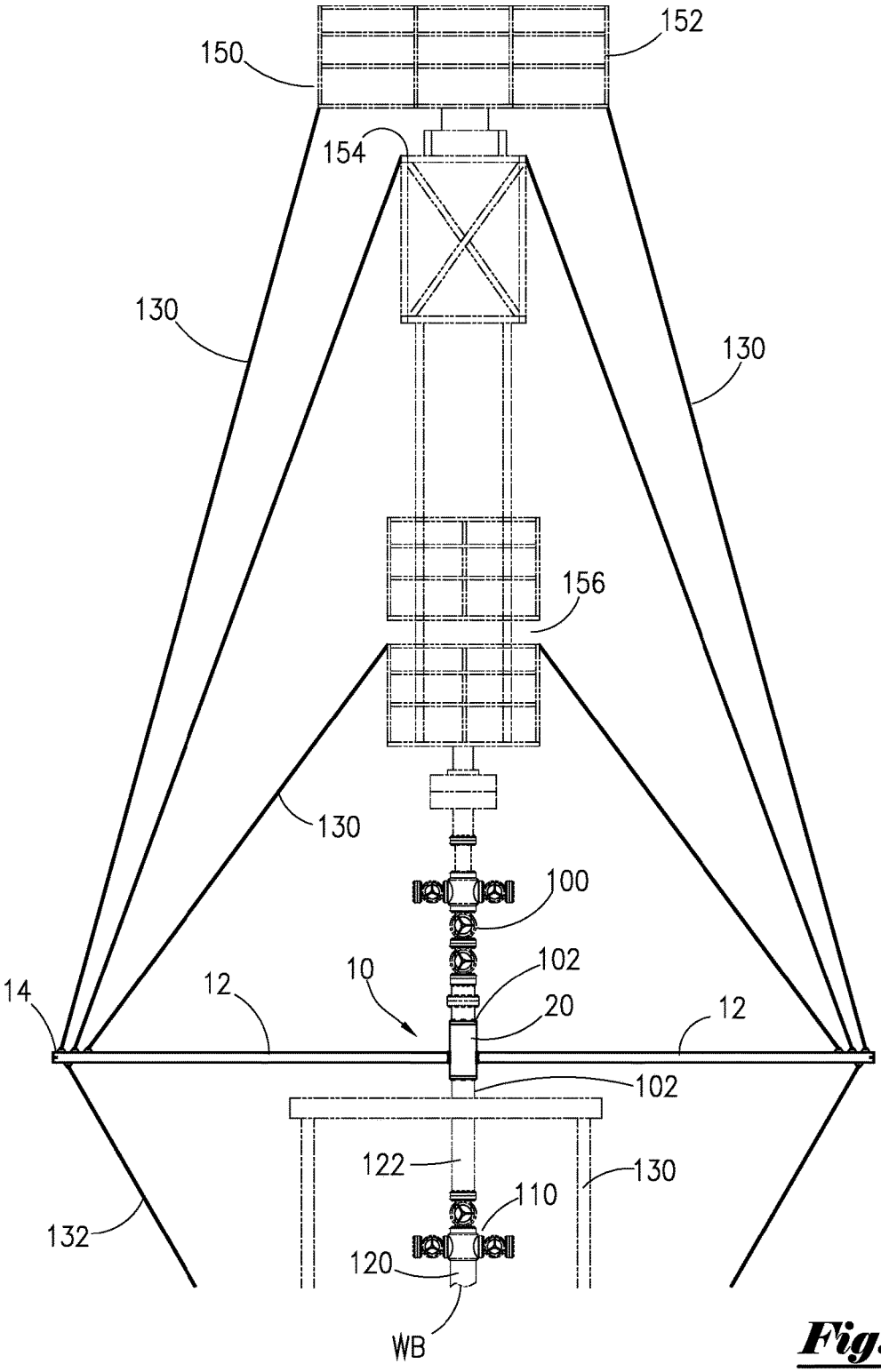
FIG. 1 is a side view of the anchor spool attached below a BOP stack of a wellhead at an offshore location; the support beams of the anchor spool are shown supporting a snubbing unit work window, snubbing jack and workbasket.

FIG. 1 suggests one embodiment of the invention, an anchor assembly including a spool body and a beam support assembly. FIG. 1 shows one embodiment of the spool body 10 (also sometimes referred to as the "anchor spool" 10) mounted on casing string 120 of wellbore WB at offshore well platform 151 in a position below BOP stack 100 and axially in line with the BOP stack 100 of the pressure containment system 110 of wellbore WB. The anchor spool 10 has a plurality of detachable, radially extending, cantilevered support beams 12. The support beams are "cantilevered" in one sense by the fact that their distal ends do not have legs extending to a land or subsea surface from which the well stack (as defined below) extends. The anchor spool 10 with the support beams 12 provide a temporary support framework for attachment of guide members 130 extending from the workbasket 152, snubbing jack 154, and work window 156 of snubbing unit 150 mounted upon the BOP stack 100. Guywires 132 may be provided to extend from support beams 12 for attachment to the well platform 151. In certain embodiments, the guide members are chains, guywires, and/or cables 130. While chains, cables, and guywires are examples of non-rigid or flexible guide members, other embodiments could include stiff or rigid guide members such as rigid metal rods or tubes. The entire tubular well assembly from the land or subsea surface to the work window 156 will sometimes be referred to as the "wellhead stack."

Figure 2:
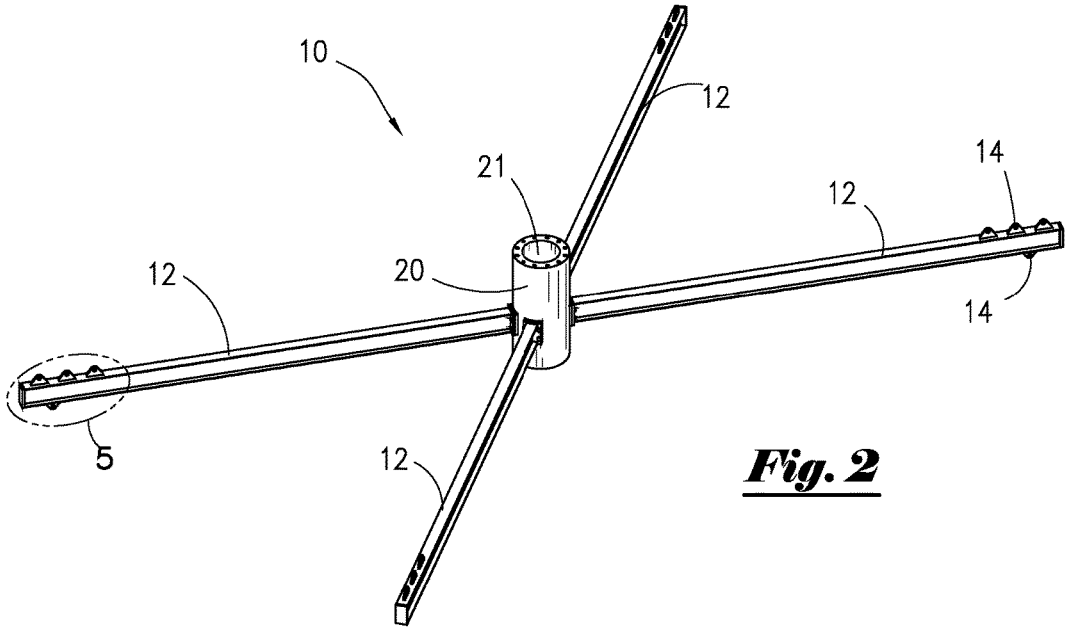
FIG. 2 is an isometric view of the anchor spool shown in FIG. 1.
Figure 3:
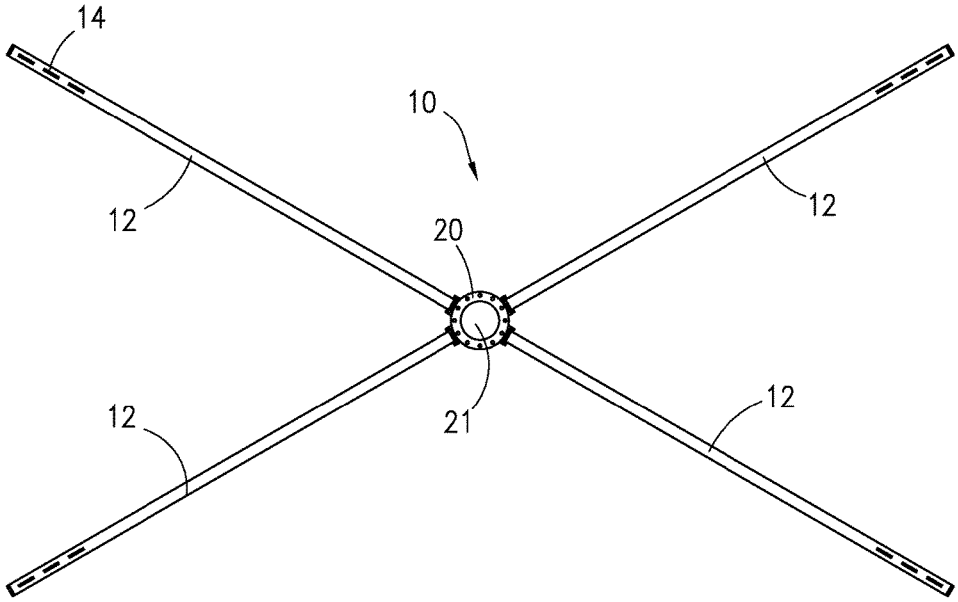
FIG. 3 is a top view of the anchor spool shown in FIG. 1.
Figure 4:
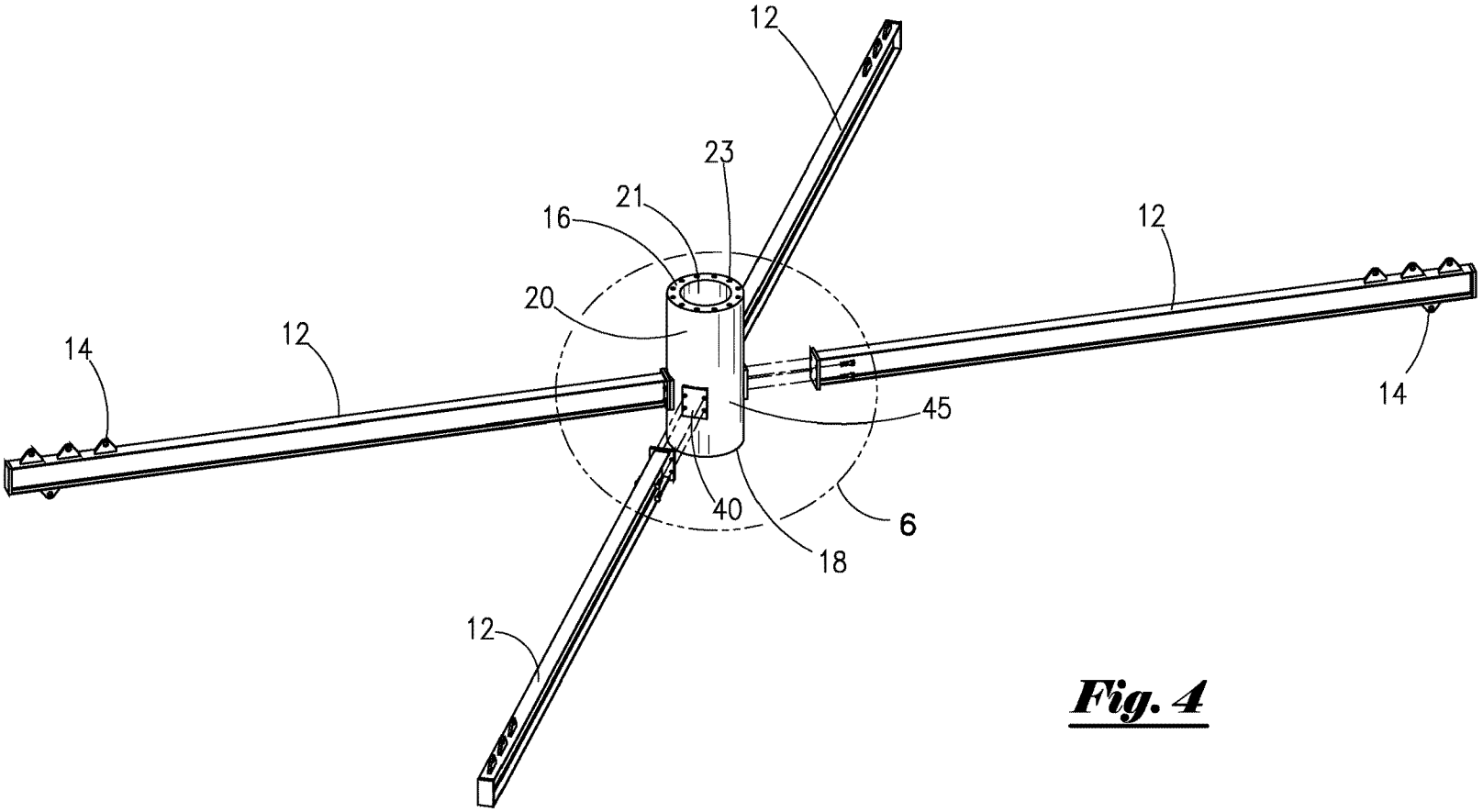
FIG. 4 is an isometric exploded view of the anchor spool shown in FIG. 1.

As shown in FIGS. 2-4 anchor spool 10 has a body 20 with an axial central bore 21. The anchor spool 10 also has an outer dimension, which is the outer diameter in the example spool 10 being cylindrical (as opposed to an outer surface which is square, hexagonal, etc.). The cylindrical spool 10 seen in FIG. 2 has a height greater than the diameter of its central bore. A plurality of internally threaded bolt holes 23 are positioned around the central bore 21 of the anchor spool body 20 at its axial ends. The bolt holes 23 are configured to match the bolt hole patterns of the mounting flanges 102 of the BOP stack 100 and the casing string 120 or any intervening riser spools 122 that may be in place.

Figure 6:
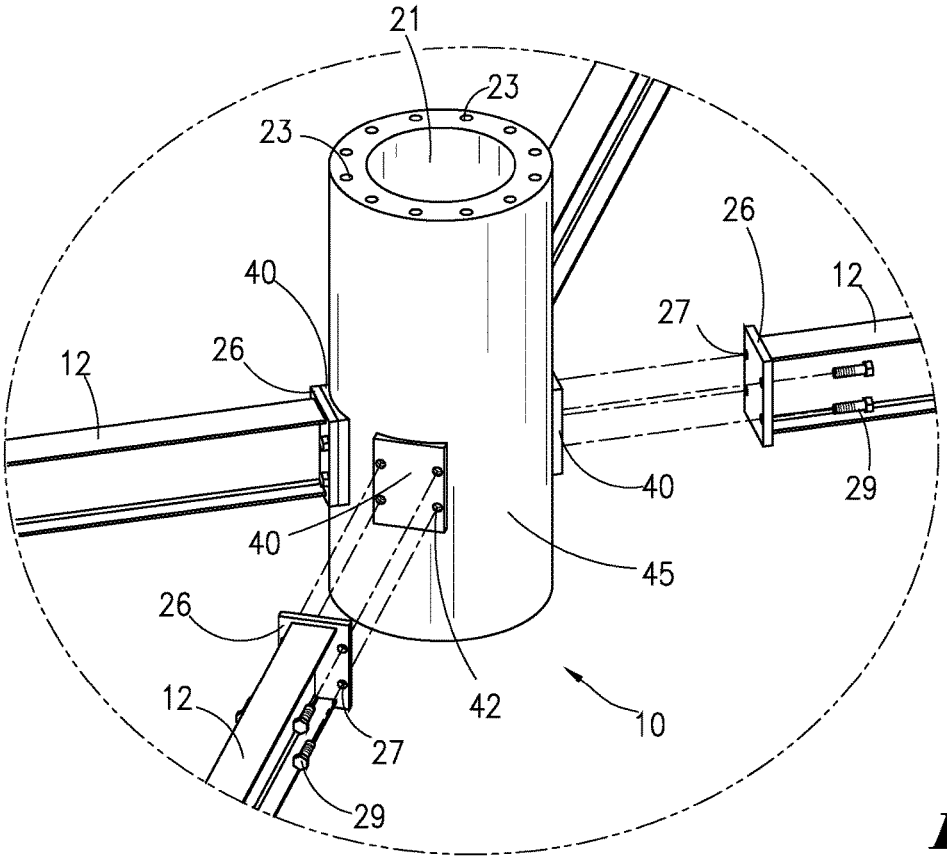
FIG. 6 is a partial isometric exploded view of the support beams and body of the anchor spool shown in FIG. 7 is a partial isometric exploded view of another embodiment of the anchor spool.

As shown in FIG. 6, the anchor spool body 20 has an upper axial end 16, a lower axial end 18, and a plurality of flat surfaces 40 formed on its outer peripheral surface 45. Bolt holes 23 are positioned around the central bore 21 on the upper axial end 16 of the anchor spool body 20 in a desired pattern, preferably a pattern that will conform to the bolt hole pattern of the mounting flanges 102 of blowout preventer on the BOP stack 100 or any intervening riser spools 122 of the pressure containment system 110. Similarly, bolt holes 23 are positioned around the central bore 21 on the lower axial end 18 of the anchor spool body 20.

Figure 5:
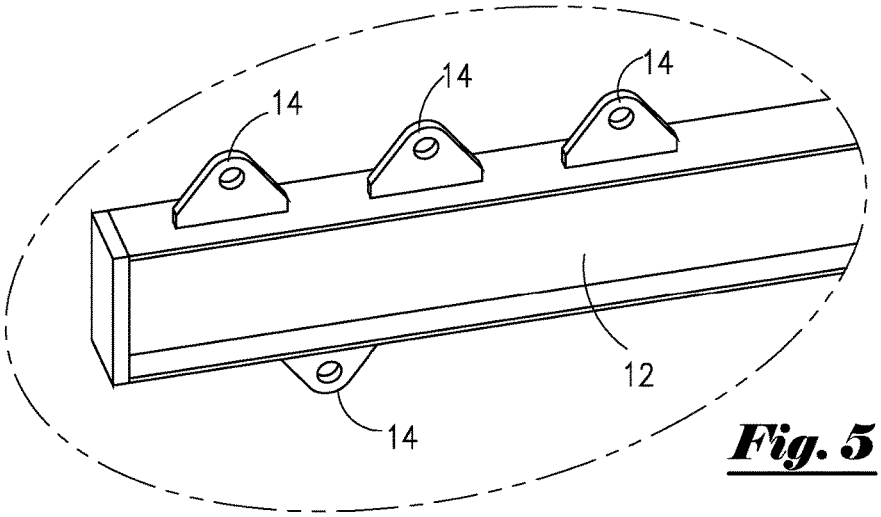
FIG. 5 is an isometric view detail view of the guywire pad eyes of the anchor spool shown in FIG. 1.

The flat surfaces 40 have a plurality of threaded bolt holes 42 and form one embodiment of the beam support assembly. The flat surfaces 40 correspond with an end plate 26 on each support beam 12. Each end plate 26 has a plurality of bolt holes 27 that correspond with the threaded bolt holes 42 on the flat surfaces 40 of the anchor spool body 20. Anchor bolts 29 are positioned through the bolt holes 27 of each end plate 26 and threadedly attached to anchor spool 10 at threaded bolt holes 42 to hold each support beam 12 in place on the anchor spool body 20 as shown in FIGS. 2-4 and 6. The anchor bolts 29 are removable from bolt holes 42 on the anchor spool body 20 so that the support beams 12 may be detached from spool body 20 for ease of transportation and for ease of disassembly and re-assembly. As shown in FIG. 5, pad eyes 14 are provided on each support beam 12 for attachment of guywires 130 or 132.

Other means for attachment of the support beams 12 to the anchor spool 10 may be utilized. For instance, a plurality of brackets or a short stub beams (not shown) may be welded or bolted to the anchor spool body 20 and these brackets or short stub beams could be used to provide an attachment surface for the support beams 12. The support beams 12 could be pivotally attached to the brackets or short stub beams so that the support beams could be pivoted to run along the axial length of the anchor spool body. For use the support beams 12 could be pivoted to extend radially outward from the anchor spool body as shown in FIGS. 2 to 4. The support beams could then be pinned or bolted to the brackets or stub beams to hold the support beams in the extended position.

Figure 7:
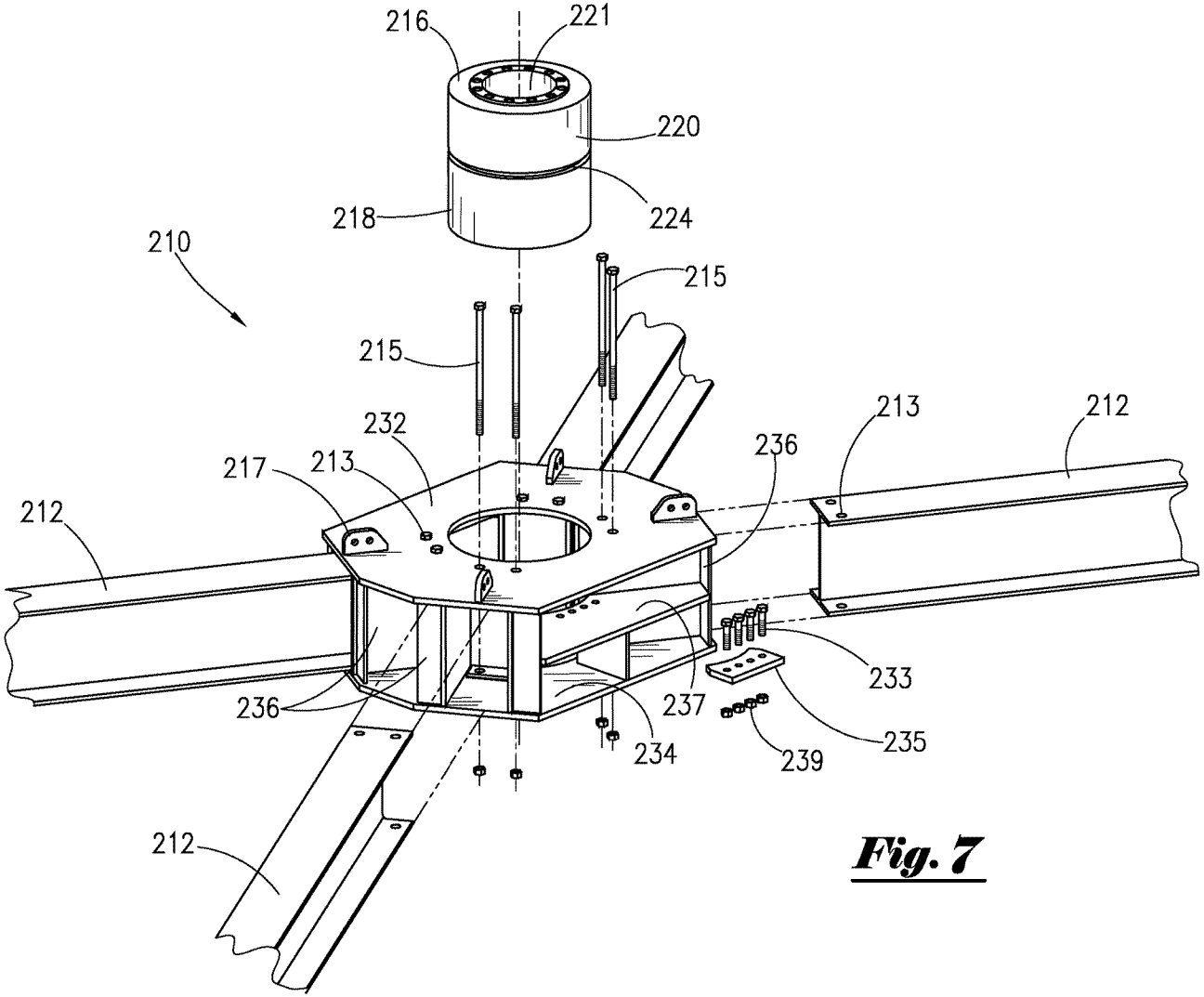
Figure 8:
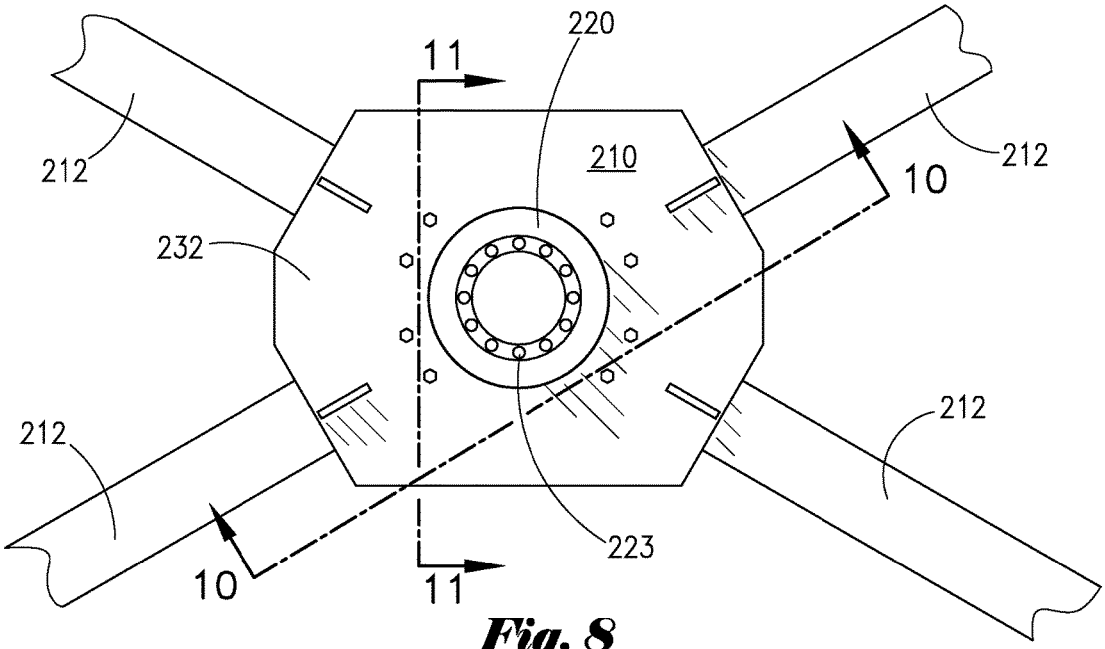
FIG. 8 is a partial top view of the anchor spool embodiment shown in FIG. 7.
Figure 9:
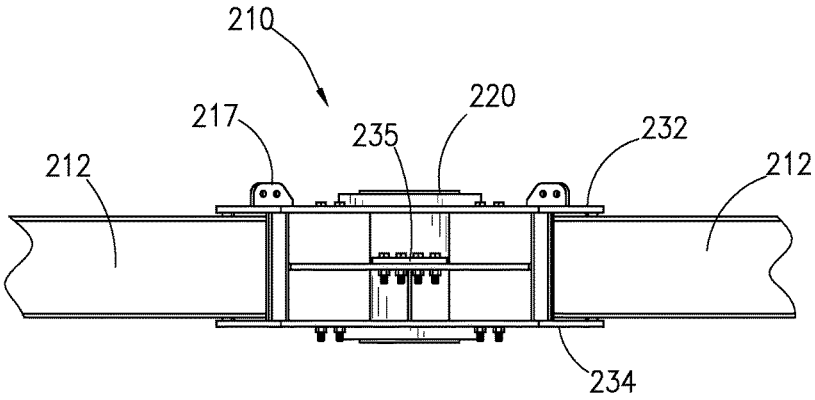
FIG. 9 is a partial side view of the anchor spool embodiment shown in FIG. 7.

FIGS. 7 to 9 show another embodiment of the anchor assembly designated as 210 (sometimes also referred to as "anchor spool" 210). Anchor assembly embodiment 210 has a spool body 220 with an axial central bore 221. A plurality of internally threaded bolt holes 223 are positioned around the central bore 221 of the body 220 at its upper axial end 216 and at its lower axial end 218. The bolt holes 223 are configured to match the bolt hole patterns of the mounting flanges 102 of the BOP stack 100 and the casing string 120 or any intervening riser spools 122 that may be in place.

Figure 10:
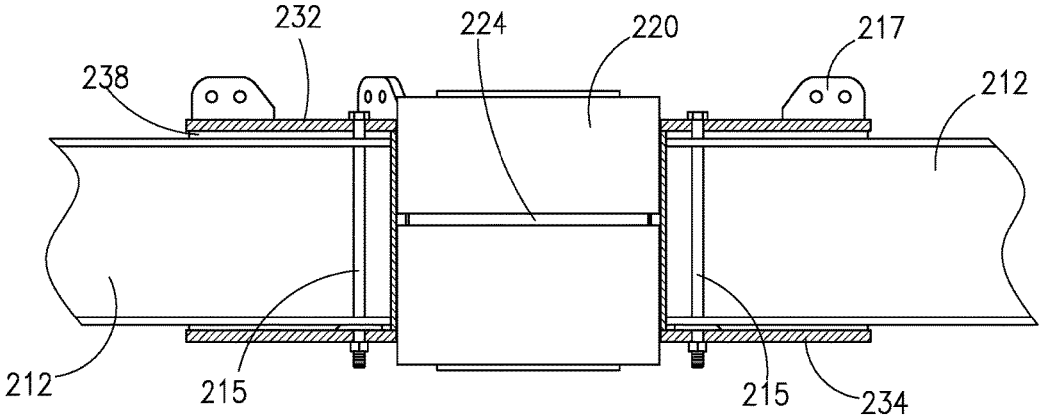
FIG. 10 is a partial cross-section view of the anchor spool embodiment of FIG. 7 showing connection of the support beams to the support beam sleeve.

The spool body 220 of anchor assembly embodiment 210 is releaseably attached to a beam support sleeve 230. Beam support sleeve 230 (also an example of a "beam support assembly") has an upper sleeve plate 232, a lower sleeve plate 234 and a plurality of vertical stiffeners 236. The stiffeners 236, the upper sleeve plate 232, and the lower sleeve plate 234 define a plurality of beam support pockets 238 (one example of "beam attachment points") extending from the periphery of support sleeve 230. A detachable, radially extending, cantilevered support beam 212, having a plurality of pad eyes 14 as shown in FIGS. 1-5 for support beam 12, is removably fitted into each beam support pockets 238 and secured in place by removable pins or bolts 215 through bolt holes 213 as shown in FIGS. 7 and 10. The anchor spool 210 with the support beams 212 provide a temporary support framework for incorporation into casing string 120 of wellbore WB at offshore well platform 151 for attachment of guywires and cables 130 in a manner similar to that shown in FIG. 1.

Figure 11:
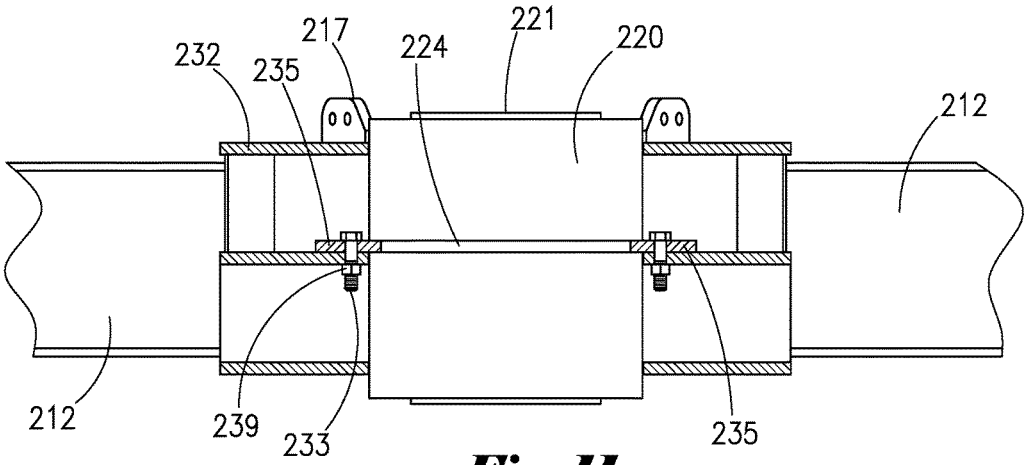
FIG. 11 is a partial cross-section view of the anchor spool embodiment of FIG. 7 showing connection of the support beam sleeve to the spool body.

Body 220 has a mounting groove 224 extending around the periphery of the body 220 used for attachment of a beam support sleeve 230. Intermediate sleeve anchor plates 237 are positioned between the upper and lower sleeve plates 232, 234 of the beam support sleeve 230. The beam support sleeve 230 is attached to the body 220 by a plurality of attachment plates 235 (one example of "spool connectors") that fit into the mounting groove 224 of body 220. Attachment plates 235 are secured to intermediate sleeve anchor plates 237 by removable mounting bolts 233 and nuts 239, as shown in FIGS. 7 and 11, to hold the beam support sleeve 230 on body 220. Anchor spool 210 may have pad eyes 217 to facilitate lifting and attachment to the spool body 220.

The bodies 20, 220 of anchor spools 10, 210, respectively, may be removably mounted to flanges 102 of a BOP stack 100 or a spacer spool 122 by means of threaded bolts through the attachment flange 102 into bolt holes 23 or 223 in their upper and lower axial ends. The support beams 12 or 212 may then be attached to the anchor spools 10, 210 as described for each embodiment. Guywires or cables 130, 132 may then be attached to pad eyes 14 on the support beams 12, 212 as shown in FIG. 1.

Figure 12:
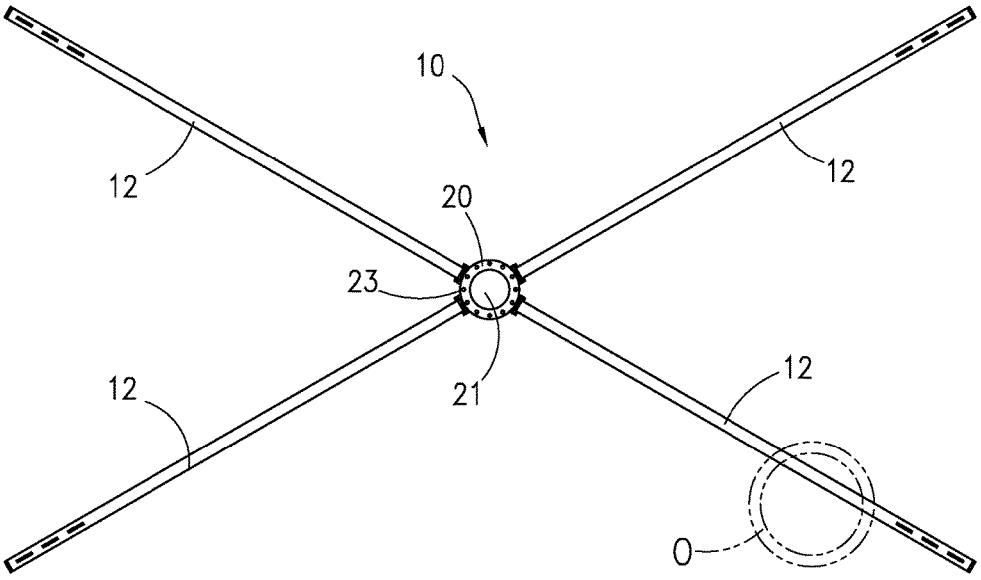
FIGS. 12 and 13 illustrate rotation of the anchor spool during installation to avoid existing obstructions.
Figure 13:
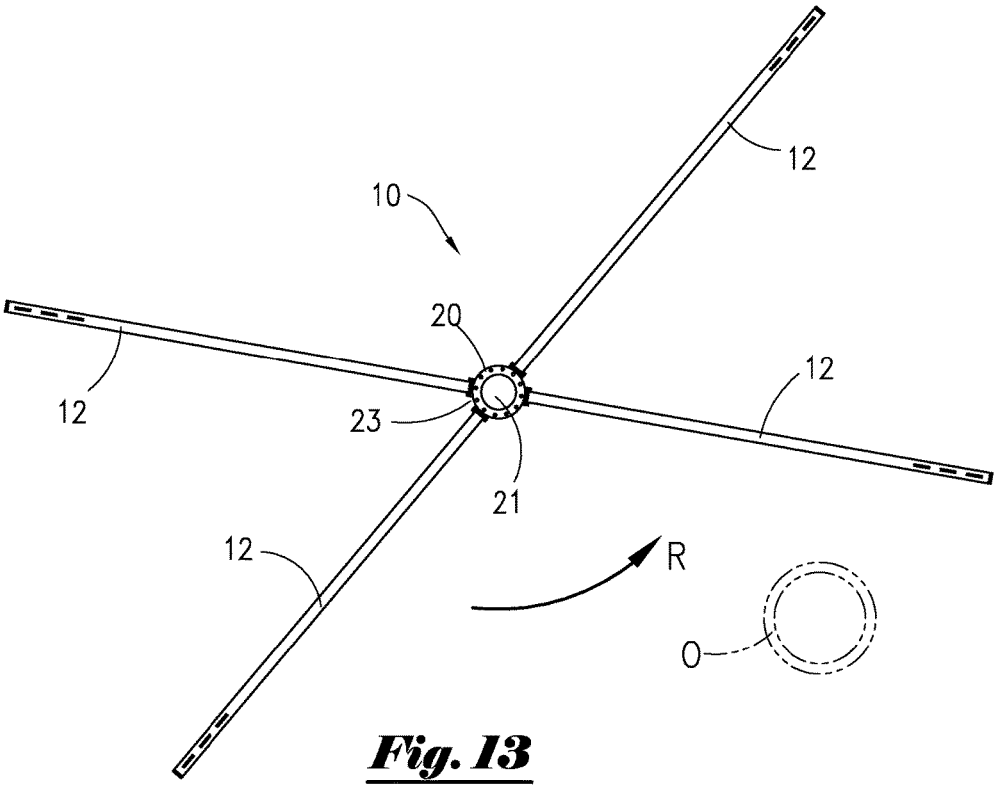

Bolt holes 23 and 223 of anchor spools 10, 210, respectively, are preferably patterned to conform to the circular bolt hole patterns of the mounting flanges 102 on the BOP stack 100 and any intervening riser spools of the pressure containment system 110. This will allow the rotation of the anchor spools 10, 210 on flanges 102 during installation to orient the support beams 12 or 212 in order to avoid existing well site obstructions. For example, in the event anchor spool 10 is positioned where a support beam 12 will encounter an existing obstruction 0, as shown in FIG. 12, the anchor spool 10 may be rotated on the mounting flange in a desired direction R, as shown in FIG. 13, in order to place a support beam 12 in a position where obstruction 0 may be avoided.

The ability to rotate the anchor spool to avoid obstructions will ease its installation, avoid costly field fixes, and reduce the potential for injury to workers during installation. Because of their unique design, the anchor spools described herein may be fabricated offsite and delivered to a well site for installation. Anchor spools 10, 210 may be readily attached to the casing string and the BOP stack and will eliminate the need for preparing a temporary BOP stack framework in advance of installation of the snubbing unit or other workover equipment. The anchor spools 10, 210 eliminate the need to custom tailor and fabricate a temporary framework at the well site before a snubbing unit or other workover equipment can be set up for operation. This will reduce the cost of installation of this equipment and the risk of injury to workers.

In certain embodiments, an anchor assembly 210 as seen in FIG. 7 will include multiple alternative spool bodies 220, each spool body having a different diameter central bore 221. The different diameter central bores 221 will correspond to the different inner diameters (i.e., central passages) of the various standard-sized oilfield tubulars which may be used to form the well stack at a particular wellhead. The outer diameter of the different spool bodies 220 will typically be the same. Thus, when a wellhead is encountered which has a different diameter central passage than a previous wellhead on which the anchor assembly 210 was used, it is only necessary to secure the correct inner diameter sized spool body 220 between the upper and lower sleeve plates 232/234 (as opposed to substituting an entirely different anchor assembly or beam support assembly).

It will be seen that changes may be made in the form, construction and arrangement of the parts of the anchor spool described and their accessories without departing from the spirit and scope of the invention or sacrificing any of the invention's material advantages. The description and drawings provided give only exemplary embodiments and methods of use and assembly of the anchor spool and it will be appreciated that the invention can be practiced by other than the described embodiments, which are presented only for illustration and not limitation.

The invention claimed is:

1. A wellhead structural system comprising:

(a) a wellhead stack extending upward from a land or subsea surface and having a central passage;

(b) an anchor assembly including a spool body with a central bore, (i) the spool body being positioned along the wellhead stack such that the central bore forms part of the central passage of the wellhead stack, and (ii) the spool body having a height that is greater than a diameter of the central bore;

(c) a plurality of support beams attached to the anchor assembly and extending outwardly therefrom in a substantially radial direction from the wellhead stack central passage;

(d) each support beam having (i) an upper guide member extending upward to attach to a structure above the anchor assembly, and (ii) a flexible lower guide member extending downward to attach to a well structure below the anchor assembly.

2. The wellhead assembly of claim 1, wherein the guide members are at least one of cables, chains, guywires, or rigid rods.

3. The wellhead assembly of claim 1, wherein the lower guide member extends both downwardly and inwardly toward the well structure below the anchor assembly.

4. The wellhead assembly of claim 1, wherein the guide members extending upward attach to a work platform supported by the wellhead stack.

5. The wellhead assembly of claim 4, wherein the work platform is a workbasket of a snubbing unit and the support beams are aligned with corners of the workbasket.

6. The wellhead assembly of claim 1, wherein wellhead stack includes a BOP stack and the spool body is positioned along the BOP stack.

7. A wellhead structural system comprising:

(a) a wellhead stack extending upward from a land or subsea surface and having a central passage;

(b) an anchor assembly including a spool body with a central bore, (i) the spool body being positioned along the wellhead stack such that the central bore forms part of the central passage of the wellhead stack, and (ii) the spool body having a height that is greater than a diameter of the central bore;

(c) a plurality of support beams attached directly to the spool body and extending outwardly therefrom in a in substantially radial direction from the wellhead stack central passage; and (d) each support beam having a guide member extending upward to attach to a well structure above the anchor assembly.

8. A wellhead structural system comprising:

(a) a wellhead stack extending upward from a land or subsea surface and having a central passage;

(b) an anchor assembly including top and bottom plates into which a spool body is inserted, (i) the spool body having a central bore, (ii) the spool body being positioned along the wellhead stack such that the central bore forms part of the central passage of the wellhead stack, and (iii) the spool body having a height that is greater than a diameter of the central bore;

(c) a plurality of support beams attached to the anchor assembly and extending outwardly therefrom in a in substantially radial direction from the wellhead stack central passage; and (d) each support beam being connected to the top and bottom plates and having a guide member extending upward to attach to a well structure above the anchor assembly.

9. A wellhead structural system comprising:

(a) a wellhead stack extending upward from a land or subsea surface and having a central passage;

(b) an anchor assembly including a spool body with a central bore, (i) the spool body being positioned along the wellhead stack such that the central bore forms part of the central passage of the wellhead stack, and (ii) the spool body having a height that is greater than a diameter of the central bore;

(c) a spool connector configured to releasably fix the spool body in place at least partially between upper and lower plates;

(d) a plurality of support beams attached to the anchor assembly and extending outwardly therefrom in a in substantially radial direction from the wellhead stack central passage;

(e) each support beam having a guide member extending upward to attach to a workbasket of a snubbing unit supported by the well platform and the support beams being aligned with corners of the workbasket.

10. The wellhead assembly of claim 1, the spool body comprises a bolt hole pattern with bolt holes extending through the spool body in a direction parallel with its central bore.

11. A wellhead structural system comprising:

(a) a wellhead stack extending upward from a land or subsea surface, the wellhead stack including a BOP stack and a central passage;

(b) an anchor assembly including top and bottom plates into which a spool body with a central bore is inserted, (i) the spool body being positioned along the BOP stack such that the central bore forms part of the central passage of the BOP stack, and (ii) the spool body having a height that is greater than a diameter of the central bore;

(c) a plurality of support beams attached to the anchor assembly and extending outwardly therefrom in a substantially radial direction from the wellhead stack central passage;

(d) each support beam having an upper guide member extending upward to attach to a well structure above the anchor assembly; and (e) wherein the support beams are connected to the top and bottom plates.

12. The wellhead assembly of claim 11, further comprising each support beam having a lower guide member extending downward to attach to a well structure below the anchor assembly.

13. The wellhead assembly of claim 11, wherein the guide members are cables.

14. The wellhead assembly of claim 11, wherein the guide members extending upward attach to a work platform supported by the wellhead stack.

15. The wellhead assembly of claim 14, wherein the work platform is a workbasket of a snubbing unit and the support beams are aligned with corners of the workbasket.

16. The wellhead assembly of claim 11, further comprising a spool connector configured to releasably fix the spool body in place at least partially between the upper and lower plates.

17. The wellhead assembly of claim 11, the spool body comprises a bolt hole pattern with bolt holes extending through the spool body in a direction parallel with its central bore.

18. A wellhead structural system comprising:

(a) a wellhead stack extending upward from a land or subsea surface and having a central passage;

(b) an anchor assembly including a spool body with a central bore, (i) the spool body being positioned along the wellhead stack such that the central bore forms part of the central passage of the wellhead stack, and (ii) the spool body having a height that is greater than a diameter of the central bore;

(c) a plurality of support beams attached to the anchor assembly and extending outwardly therefrom in a in substantially radial direction from the wellhead stack central passage;

(d) each support beam having (i) an upper guide member extending upward to attach to a well structure above the anchor assembly, and (ii) a lower guide member extending downwardly and inwardly toward the well structure in order to attach to a well structure below the anchor assembly.

19. The wellhead assembly of claim 18, wherein the lower guide member is a flexible guide member.

20. The wellhead structural system of claim 19, wherein the well structure above the anchor assembly is a snubbing unit.

* * * * *